United States Patent [19]

Kuhn

[11] Patent Number: 4,588,519

[45] Date of Patent: May 13, 1986

[54] METHOD OF INHIBITING CORROSION OF IRON BASE METALS

[75] Inventor: Vincent R. Kuhn, Twin Lakes, Wis.

[73] Assignee: Dearborn Chemical Company, Lake Zurich, Ill.

[21] Appl. No.: 473,157

[22] PCT Filed: Jan. 29, 1982

[86] PCT No.: PCT/US82/00122

§ 371 Date: Feb. 25, 1983

§ 102(e) Date: Feb. 25, 1983

[87] PCT Pub. No.: WO83/02628

PCT Pub. Date: Aug. 4, 1983

[51] Int. Cl.[4] ..... C09K 3/00; C23F 11/00; C23F 11/04; C04B 9/02

[52] U.S. Cl. ..... 252/389 R; 106/14.12; 106/14.13; 106/14.15; 422/12; 422/16

[58] Field of Search ..... 106/14.12, 14.13, 14.15; 422/12, 16; 252/180, 389.2

[56] References Cited

U.S. PATENT DOCUMENTS

| | | | |
|---|---|---|---|
| 3,116,248 | 12/1963 | Frew | 252/32.5 |
| 3,116,249 | 12/1963 | Ratner et al. | 252/32.5 |
| 3,578,589 | 5/1971 | Hwa et al. | 210/58 |
| 3,666,404 | 5/1972 | Hwa et al. | 21/2.7 |
| 3,709,815 | 1/1973 | Booth et al. | 210/58 |
| 3,709,816 | 1/1973 | Walker et al. | 210/58 |
| 3,806,367 | 4/1974 | Lange et al. | 134/3 |
| 3,898,037 | 8/1975 | Lange et al. | 21/2.7 R |
| 3,928,196 | 12/1975 | Persinski et al. | 210/58 |
| 3,941,562 | 3/1976 | Hollingshad | 21/2.7 |
| 3,959,167 | 5/1976 | Hwa et al. | 252/180 |
| 4,048,066 | 9/1977 | Cuisia et al. | 210/58 |
| 4,105,581 | 8/1978 | Sexsmith | 252/389 |
| 4,118,318 | 10/1978 | Welder et al. | 252/180 |
| 4,126,549 | 11/1978 | Jones et al. | 210/58 |
| 4,242,242 | 12/1980 | Allen | 260/17.4 |
| 4,255,259 | 3/1981 | Hwa et al. | 210/699 |
| 4,297,237 | 10/1981 | Boffardi | 252/389 |
| 4,303,568 | 12/1981 | May et al. | 260/29.6 |
| 4,432,879 | 2/1984 | Greaves et al. | 210/699 |

FOREIGN PATENT DOCUMENTS

| | | | |
|---|---|---|---|
| 2806342 | 8/1978 | Fed. Rep. of Germany | 106/14.13 |
| 2265873 | 3/1975 | France | 252/389.2 |
| 1532391 | 1/1977 | United Kingdom | 252/389.2 |
| 2082600A | 3/1982 | United Kingdom | 252/389.2 |

OTHER PUBLICATIONS

Betz Handbook of Industrial Water Conditioning, Seventh Edition, Betz, Trevose, Pa., 1976, pp. 197–201.

*Primary Examiner*—Christine M. Nucker
*Attorney, Agent, or Firm*—W. W. McDowell, Jr.

[57] ABSTRACT

A process for inhibiting the corrosion of iron based metals in contact with aqueous systems by incorporating in the aqueous system an effective amount of a composition comprising an inorganic phosphate and a water soluble organic copolymer of acrylamido-sulfonic acid monomers with vinyl carboxylic acid monomers.

5 Claims, No Drawings

METHOD OF INHIBITING CORROSION OF IRON BASE METALS

BACKGROUND OF THE INVENTION

The present invention relates to the inhibiting and preventing corrosion of iron based metals which are in contact with aqueous systems, such as cooling water systems.

Iron and iron metal containing alloys such as mild steel are well known materials used in the construction of apparatus in which aqueous systems circulate, contact the iron based metal surface and may be concentrated, such as by evaporation of a portion of the water from the system. Even though such metals are readily subject to corrosion in such environments, they are used over other metals due to the strength they have.

It is known that various materials which are naturally or synthetically occurring in the aqueous systems, especially such systems formed from natural resources such as seawater, rivers, lakes and the like, attack iron based metals (the term "iron based metals" shall mean in the present disclosure and the appended claims iron metal and metal alloys containing iron therein). This is especially true where the aqueous system is a hard water i.e. contains about 300 ppm or greater of calcium and magnesium therein.

Typical apparatus in which the iron metal parts are subject to corrosion include evaporators, single and multi-pass cooling towers and associated equipment and the like. As the aqueous system passes through or over the apparatus a portion of the aqueous system evaporates causing a concentration of the materials contained in the system. These dissolved materials approach and reach a concentration at which they cause severe pitting and corrosion which eventually requires replacement of the metal parts.

Various corrosion inhibitors have been previously used. These include inorganic nitrite or phosphate salts and the like. These materials have only minor inhibiting effects and tend to decompose when used in environs such as encountered in cooling towers, evaporators and similar apparatus wherein the aqueous system is subjected to elevated temperatures.

Copolymers such as described with respect to the present invention have been found, when used alone, to have substantially no corrosion inhibiting effect.

It is desired to have a composition and a method capable of being easily worked which substantially inhibits the corrosion of iron based metals. It is desired to have a composition capable of substantially inhibiting corrosion of iron base metals of apparatus in contact with aqueous systems which tend to concentrate. It is further desired to have a composition which is capable of inhibiting corrosion when used at very lower dosages.

SUMMARY OF THE INVENTION

The present invention is directed to a method of inhibiting corrosion of iron based metals which are in contact with aqueous systems by mixing with the aqueous system a threshold quantity of an inorganic phosphate and a water soluble organic copolymer formed from acrylamido-sulfonic acid monomers and vinyl carboxylic acid monomers.

DETAILED DESCRIPTION OF THE INVENTION

According to the present invention it has been surprisingly found that the desired corrosion inhibition can be achieved by the use of a specific composition. This composition is the combination of an inorganic phosphate and certain organic copolymers as described in detail hereinbelow. It has been found that the subject combination of components results in a synergistic desired effect.

Accordingly, the present invention provides a method of inhibiting corrosion of iron base metals in contact with an aqueous system by incorporating into the aqueous system a water soluble inorganic phosphate compound e.g. orthophosphoric acid, alkali metal phosphates, such as sodium or potassium orthophosphates, sodium or potassium pyrophosphates, sodium or potassium metaphosphates sodium or potassium tripolyphosphate, sodium or potassium hexametaphosphate and the like. The phosphate compound should be water soluble. The preferred salts are the sodium salts.

The copolymeric material required to be used in combination with the inorganic phosphate described above can be represented by the general formula

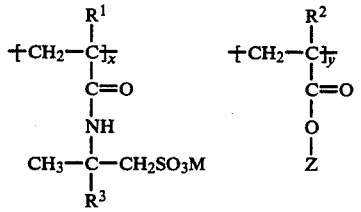

wherein $R^1$ and $R^2$ each independently represent hydrogen or methyl; $R^3$ represents hydrogen or $C_1$–$C_{12}$ straight or branch chain alkyl group, preferably a $C_1$ to $C_3$ alkyl group, or a cycloalkyl group having up to six carbon atoms or a phenyl group; M represents hydrogen or an alkali metal cation or alkaline earth metal cation or an ammonium cation or mixtures thereof selected from metal or ammonium cations which present no adverse effect to the polymer solubility in water, the preferred cations are selected from alkali metals, and ammonium cations with sodium, potassium and ammonium being most preferred; Z represents hydrogen or an alkali metal or ammonium cation or mixtures thereof; x and y are integers such that the ratio of x to y is from about 5:1 to 1:5 and the sum of x+y is such that the copolymer has a weight average molecular weight of between 1,000 and 100,000 and more preferably between 1,000 and 10,000 and most preferably between 4,000 and 6,000.

The preferred copolymers are formed from acrylic acid or methacrylic acid or their alkali metal salts in combination with 2-acrylamido-2acrylamido-2methylpropane sulfonic acid or its alkali metal or ammonium salts. The copolymers can be partially or completely neutralized as the salt. The molar ratio of the monomeric material is from 5:1 to 1:5 and preferably from 2:1 to 1:2.

The copolymer required for use in the composition of the subject invention may contain minor amounts of up to about 5 mole percent of other monomeric units which are inert with respect to the subject process such as lower ($C_1$–$C_5$) esters of acrylic or methacrylic acid, acrylonitrile and the like.

The copolymer required for forming the composition found useful in performing the subject process can be formed by conventional vinyl polymerization techniques. The monomers of 2-acrylamido-2-methylpropane sulfonic acid, methacrylic acid and acrylic acid (as appropriate) are each commerically available. The monomers are mixed in appropriate molar ratios to form the desired product and are polymerized using conventional redox or free radical initiators. Formation of low molecular weight copolymers may require the presence of chain terminators such as alcohols and the like in manners known in the art.

In general the phosphate and copolymer are used in weight ratios of from 100:1 to 1:100 and more preferably from 4:1 to 1:4 and most preferably about 1:1.

The dosage of the composition of the present invention depends, to some extent, on the nature of the aqueous system in which it is to be incorporated. In general however, it can be said that the concentration in the aqueous system can be from 1 to 200 ppm although much lower dosages of from 1 to 100 ppm is normally sufficient and even lower dosages of from 1 to 25 ppm substantially inhibits corrosion. The exact amount required with respect to a particular aqueous system can be readily determined in conventional manners.

The composition may be added to the aqueous system coming in contact with the metal surfaces of an apparatus by any convenient mode, such as by first forming a concentrated solution of the composition with water and then feeding the concentrated solution to the aqueous system at some convenient point in the operation. Alternately, the above-described phosphate and copolymer can be each separately added directly to the aqueous system to allow the formation of the subject composition to form in situ in the aqueous system. It is believed, although not made a limitation of the instant invention, that the copolymer and inorganic phosphate interact to attain the achieved corrosion inhibition which results are not attainable by use of each of the individual components. It is known that the phosphates disclosed herein have only a fair degree of corrosion inhibiting effect and that the copolymers described herein have substantially no corrosion inhibiting effect. The two components, when used in concert, causes and provides a substantial corrosion inhibiting effect.

It will be further appreciated that other ingredients customarily employed in aqueous systems of the type treated herein can be used in addition to the subject composition. Such water treatment additives are, for example, biocides, lignin derivatives and the like.

The following examples are given for illustrative purposes only and are not meant to be a limitation on the subject invention except as made in the claims appended hereto. All parts and percentages are by weight unless otherwise indicated.

EXAMPLE I

A series of tests were performed using a dynamic test apparatus which simulates conditions encountered in a recirculating cooling tower.

The apparatus comprises a vertical glass cylinder having an eight kilowatt cylindrical stainless steel cartridge heater inside. The cylinder was closed with a ballcock at the top and was equipped with temperature measurement probes at the inlet and outlet ports. The cylinder further contained a chamber in which metal (mild steel) sample coupons could be placed. An open plastic vessel having a five liter capacity was used as the open reservoir. This reservoir had an outlet tube connected to a centrifical pump which fed (via a rotometer) into the bottom inlet port of the cylinder. The outlet port is connected to the reservoir to return the aqueous fluid thereto. The reservoir also contains a cooling coil to maintain the reservoir water at 130° F. and a water make-up actuated by a diaphragm pump. The apparatus was maintained at a circulation rate of 1.5 gallon per minute with an inlet temperature of 130° F., and a pH of 7.7±0.2.

The aqueous systems which circulated through the dynamic test apparatus were synthetic hard water solutions containing 635 ppm calcium sulfate hemihydrate, 518 ppm magnesium sulfate heptahydrate, 136 ppm calcium chloride, 632 ppm sodium chloride, 816 ppm sodium sulfate, 64 ppm sodium metasilicate and 185 ppm sodium bicarbonate. In addition the aqueous systems were dosed with a copper corrosion inhibitor (benzotriazole) and a phosphonate sequestering agent (hydroxyethylidene-1, 1-diphosphonic acid).

To each of the test solutions was added a composition comprising an inorganic water soluble phosphate component in the form of 7.5 ppm active $H_3PO_4$ and 8 ppm sodium tripolyphosphate (6.3 ppm as $H_3PO_4$) and varying amounts (see Table I below) of a copolymer ($MW_w$=5000) of 2-acrylamido-2-methylpropane sulfonic acid and methacrylic acid (1:2) as the sodium salt. Duplicate clean mild steel coupon specimens were weighed and placed in the coupon specimen chamber to be subjected to a flow of the aqueous system at a rate of 1.5 gallon per minute for a period of 10 days. At the end of the 10 day test period, the steel specimens were removed, cleaned free of deposits, washed and dried. The specimens were then weighed to determine corrosion loss.

TABLE I

| Phosphate (as $H_3PO_4$) ppm | Copolymer ppm | Corrosion Rate milli-inch per year | Improvement |
|---|---|---|---|
| 13.8 | — | 7.4 | — |
| 13.8 | 4.5 | 5.8 | 22% |
| 13.8 | 7.0 | 3.6 | 51% |
| 13.8 | 9.0 | 4.0 | 46% |
| 13.8 | 10.0 | 2.2 | 70% |

A control was conducted as described above in which the phosphate components were added to the aqueous system without the addition of copolymer. The corrosion rate was calculated to be 7.4 milli inch per year. It is known that the subject copolymer does not exhibit corrosion inhibition yet Table I shows that the subject combination unexpectedly gives increased corrosion inhibition in comparison to the use of just phosphates.

EXAMPLE II

Repeat series of the above tests are conducted in the same manner as described in Example I above except that the (a) copolymer is in the form of the free acid, (b) the copolymer is formed from sulfonic acid/carboxylic acid monomer in 1:1 mole ratio and (c) an equivalent of sodium hexametaphosphate is used in lieu of the phosphates used above.

While the invention has been described in connection with certain preferred embodiments, it is not intended to limit the invention to the particular forms set forth, but, on the contrary, it is intended to cover such alternatives, modification and equivalents as defined by the appended claims.

What is claimed is:

1. A process of inhibiting corrosion of iron based metals in contact with a cooling water system comprising incorporating into the cooling water system from 1 to 200 ppm of a composition comprising (A) a water soluble inorganic phosphate and (B) a copolymer of 2-acrylamido-2-methylpropane sulfonic acid and methacrylic acid in a molar ratio of from about 5:1 to 1:5, said copolymer having a weight average molecular weight of between 1,000 and 100,000; an alkali metal, alkaline earth metal, or ammonium salt of said copolymer; or a mixture of said salts; said composition having a weight ratio of component (A) to component (B) of from 100:1 to 1:100.

2. The process of claim 1 wherein the copolymer has a weight average molecular weight of between 1,000 and 10,000.

3. The process of claim 1 wherein the water soluble inorganic phosphate is orthophosphoric acid or an alkali metal phosphate.

4. The process of claim 1 whrein the copolymer has a weight average molecular weight of from 4,000 to 6,000; the molar ratio of 2-acrylamido-2 methylpropane sulfonic acid to methacrylic acid is from 2:1 to 1:2; and the weight ratio of component (A) to component (B) is from 4:1 to 1:4.

5. The process of claim 1 wherein the copolymer has a molar ratio of 2-acrylamido-2-methylpropane sulfonic acid to methacrylic acid of from 1:1 to 1:2.

* * * * *